US006866815B2

(12) United States Patent
Gohres et al.

(10) Patent No.: US 6,866,815 B2
(45) Date of Patent: Mar. 15, 2005

(54) METALLURGICAL VESSEL AND METHOD FOR PRODUCING THE SAME

(75) Inventors: Hans-Werner Gohres, Duisburg (DE); Franz-Josef Divjak, Rheinberg (DE); Norbert Asmus, Moers (DE); Olaf Kleinjan, Moers (DE); Sait Taniyan, Moers (DE)

(73) Assignee: Mannesmannröhren-Werke AG, Mühlheim (DE)

( * ) Notice: Subject to any disclaimer, the term of this patent is extended or adjusted under 35 U.S.C. 154(b) by 0 days.

(21) Appl. No.: 10/407,913

(22) Filed: Apr. 4, 2003

(65) Prior Publication Data

US 2003/0222381 A1 Dec. 4, 2003

Related U.S. Application Data

(63) Continuation of application No. PCT/DE01/03868, filed on Oct. 4, 2001.

(30) Foreign Application Priority Data

Oct. 5, 2000 (DE) ..... 100 50 835

(51) Int. Cl.[7] ..... B22D 41/04
(52) U.S. Cl. ..... 266/246; 266/44
(58) Field of Search ..... 266/44, 243, 246, 266/245

(56) References Cited

U.S. PATENT DOCUMENTS

| | | | | |
|---|---|---|---|---|
| 3,503,599 | A | 3/1970 | Jansa et al. | |
| 6,036,916 | A | 3/2000 | Gohres et al. | |
| 6,110,414 | A | 8/2000 | Gorhes et al. | |
| 6,613,272 | B2 * | 9/2003 | Divjak et al. | 266/246 |

FOREIGN PATENT DOCUMENTS

| | | |
|---|---|---|
| DE | 195 38 530 C | 12/1996 |
| DE | 197 06 056 C | 5/1998 |
| DE | 100 33 966 C | 10/2001 |
| WO | WO 00/47353 A | 8/2000 |

* cited by examiner

*Primary Examiner*—Scott Kastler
(74) *Attorney, Agent, or Firm*—Henry M. Feiereisen

(57) ABSTRACT

A metallurgical vessel for transporting molten metals with a metal jacket with a heat-resistant lining is disclosed. The jacket has two reinforcing rings extending in the peripheral direction and being secured to and integrated in the jacket. The vessel also has two one-part shield segments, each affixed to at least to one of two stiffening rings. The shield segments include arms that extend in both peripheral directions and are provided with a welding edge for welding to the stiffening rings. Two lifting lugs are disposed on the exterior of the vessel on opposing sides thereof and supported by the stiffening rings. A stiffening ring can be implemented as two 120° segments connected at their ends to the two shield segments which each extend over 60° along the periphery.

19 Claims, 6 Drawing Sheets

Fig. 1

METALLURGICAL VESSEL AND METHOD FOR PRODUCING THE SAME

CROSS-REFERENCES TO RELATED APPLICATIONS

This application is a continuation of prior filed co-pending PCT International application no. PCT/DE01/03868, filed Oct. 4, 2001, on which priority is claimed under 35 U.S.C. § 120, the disclosure of which is hereby incorporated by reference.

This application claims the priority of German Patent Application, Serial No. 100 50 835.9, filed Oct. 5, 2000, pursuant to 35 U.S.C. 119(a)–(d), the disclosure of which is incorporated herein by reference.

BACKGROUND OF THE INVENTION

The present invention relates to a metallurgical vessel for transporting molten metals, and more particularly to a vessel with lifting lugs.

U.S. Pat. No. 6,036,916 discloses a vessel for metallurgical uses which includes a metal jacket with a heat resistant lining composed of individual lengths of pipe and provided with peripheral stiffening rings. Two lifting lugs are disposed on the exterior of the vessel on opposite sides of the vessel and supported by a plate connected to the stiffening ring. Depending on the axial dimensions of the vessel, more than two stiffening rings are provided as an integral component of the metal jacket, and the center region of the plate is positioned at a small distance from the metal jacket. The upper and lower flanged marginal region of the plate is connected with the adjacent stiffening ring. The lifting ring extends only from the plate outwardly.

U.S. Pat. No. 6,110,414 discloses an improved version wherein the first stiffening ring that is located closer to the bottom has an upwardly pointing, nose-shaped extension in the region of the plate which is formed as a shield segment. The second stiffening ring located farther away from the bottom has a downwardly pointing nose-shaped extension in the region of the shield segment. The shield segment is welded between the extensions, whereby the transition from the corresponding extension into a corresponding stiffening ring is curved both in a longitudinal cross-sectional as well as in a top view. The last-mentioned curved sections transition smoothly, i.e. kink-free, into corresponding curved sections of the shield segment.

Disadvantageously, both designs require a long connecting seam for securing the shield segment of the metal jacket. Moreover, orienting the shield segment with respect to the stiffening rings can be a complex process.

It would therefore be desirable and advantageous to provide a less complex metallurgical vessel for transporting molten metals, which obviates prior art shortcomings and can be manufactured less expensively than conventionally constructed vessels.

SUMMARY OF THE INVENTION

According to one aspect of the present invention, a metallurgical vessel for transporting molten metals includes a metal jacket with a heat resistant lining and two circumferential, axially spaced stiffening rings which are secured to and integrated with the metal jacket. Two lifting lugs are arranged in opposing disposition on an outside surface of the metal jacket. Shield segments are connected with the stiffening rings, with each shield segment supporting a corresponding lifting lug and having a rounded transition from the stiffening rings to the shield segment. Each shield segment is formed as a single piece, with at least an upper region of the shield segment having arms extending in both circumferential directions of the metal jacket. End regions of the arms have a weld edge, and the cross-sections of the weld edge and the stiffening ring proximate to the arms are matched to each other.

Instead of the long weld seam extending in the peripheral direction, at least two, typically four, short transverse seams are required for connecting the shield segment with the stiffening ring(s). This configuration can be applied for connecting various shapes, types and forms of shield segments to the metal jacket.

According to another aspect of the invention, the manufacturing costs can be reduced even further by producing a support structure from several 120° segments of the 360° stiffening ring. In this embodiment, the metallurgical vessel for transporting molten metals has a welded construction with a metal jacket being made of individual lengths of tube and a heat resistant lining and two axially spaced sections of stiffening rings which each extend about 120° along the periphery of the metal jacket and are secured to an outside surface of the metal jacket. Two shield segments are connected with the sections of the stiffening rings and form a support structure, wherein each shield segment has a rounded transition from the sections of the stiffening rings to the shield segment. Two lifting lugs are arranged in opposing disposition on the outside surface of the metal jacket and welded into an opening of the shield segment. Each shield segment extends over 60° along the periphery of the metal jacket and is formed as a single piece, with at least an upper region of the shield segment including arms extending in both circumferential directions of the metal jacket. End regions of the arms have a weld edge and a cross-section that matches a cross-section of the section of the stiffening ring proximate to the arms.

According to yet another aspect of the invention, a new process is proposed for producing the stiffening rings. Instead of forging the stiffening rings, the stiffening rings can be rolled as straight profiles and bent into corresponding 120° segments after being cut to a predetermined length. The end regions can be mechanically finished to provide the weld edges.

Since the support structure is formed from two 120° segments of the stiffening rings and two shield segments, with each of the shield segments extending over 60°, the third 120° segment of the corresponding stiffening ring can be used for the next vessel. Therefore, if two vessels are produced, a total of at least two 120° segments are left over for a third vessel. The cutting waste generated when the 360° stiffening ring is cut has to be taken account in the production of the two 60° shield segments. Likewise, when producing a vessel with an elongated or oval cross-section, the length of the corresponding straight sections has to be taken into consideration and the shield segment is shaped so as to conform to the substantially oval cross-section.

Advantageous embodiments may include one or more of the following features. A small radial gap can exits between the shield segment and the metal jacket. An upper and/or a lower region of the shield segment can include arms extending in both circumferential directions. If only an upper marginal region of the shield segment is materially connected with the stiffening ring, then an opposite free marginal region of the shield segment can be guided in the vertical direction by guide means arranged on the stiffening ring. The shield segments can form a part of the metal jacket.

The inside of the shield segment can have a recess with a cross-sectional area that is at least as large as a cross-sectional area of an end face of the lifting lug facing the outside surface of the metal jacket.

The vessel can also include a lid support that is attached on a rim of the vessel and has a frusto-conical cross-section.

Until now, the shield segment was typically produced as a forged part. Alternatively, according to another feature of the invention, it is proposed to produce the one-piece shield segment from thick sheet metal. In this practice, a thick metal sheet is rolled from a cast ingot and is subsequently bent warm or cold in a press after being sized. The thickness of the metal sheet and the selected material determine if warm or cold forming should be selected. The desired contour as well as the opening for the lifting lug can be eroded by heat, and the final contour can subsequently be produced by mechanical finishing.

For producing a sufficiently fine-grained texture, the re-forming ratio from a cast ingot to a thick metal sheet should corresponds at least to the forging ratio of a conventionally produced shield segment.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
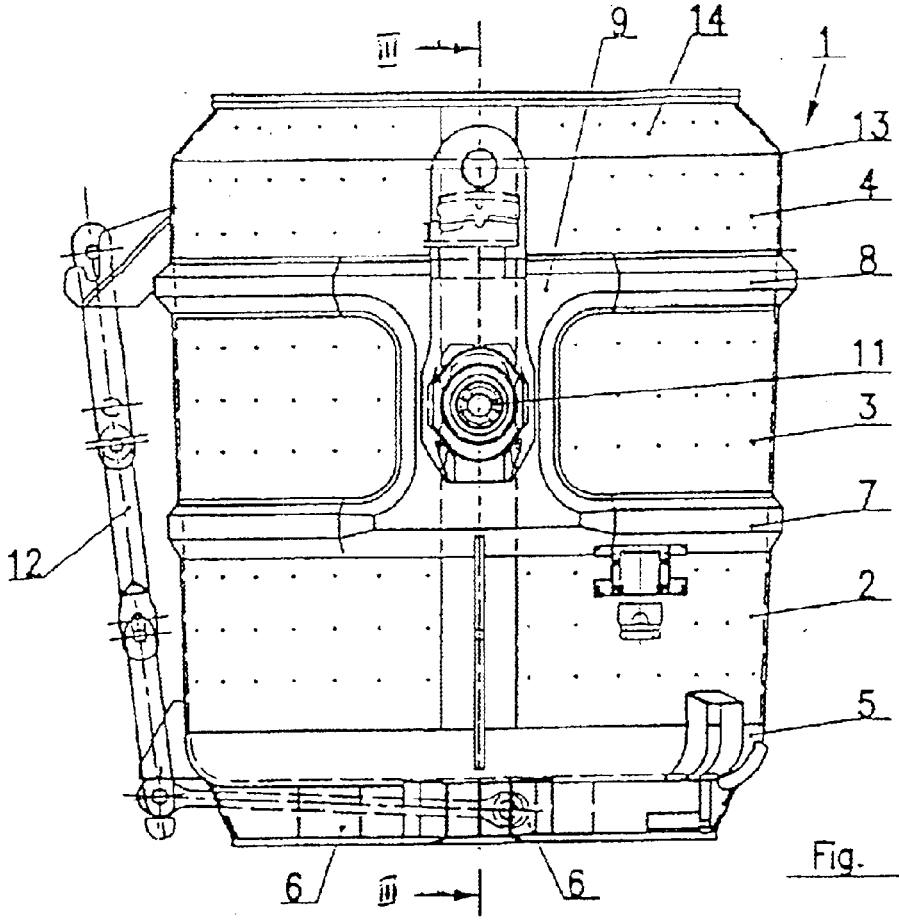
FIG. 1 is an outside view of a steel casting ladle produced according to the invention.

Throughout all the Figures, same or corresponding elements are generally indicated by same reference numerals. These depicted embodiments are to be understood as illustrative of the invention and not as limiting in any way.

Figure 2:
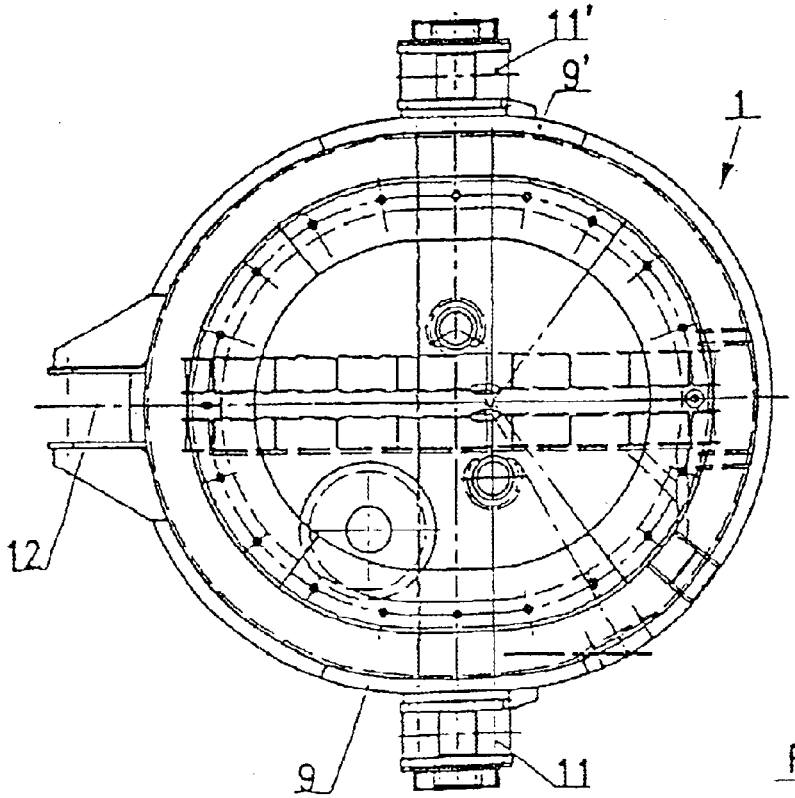
FIG. 2 is a top view of the steel casting ladle of FIG. 1.
Figure 3:
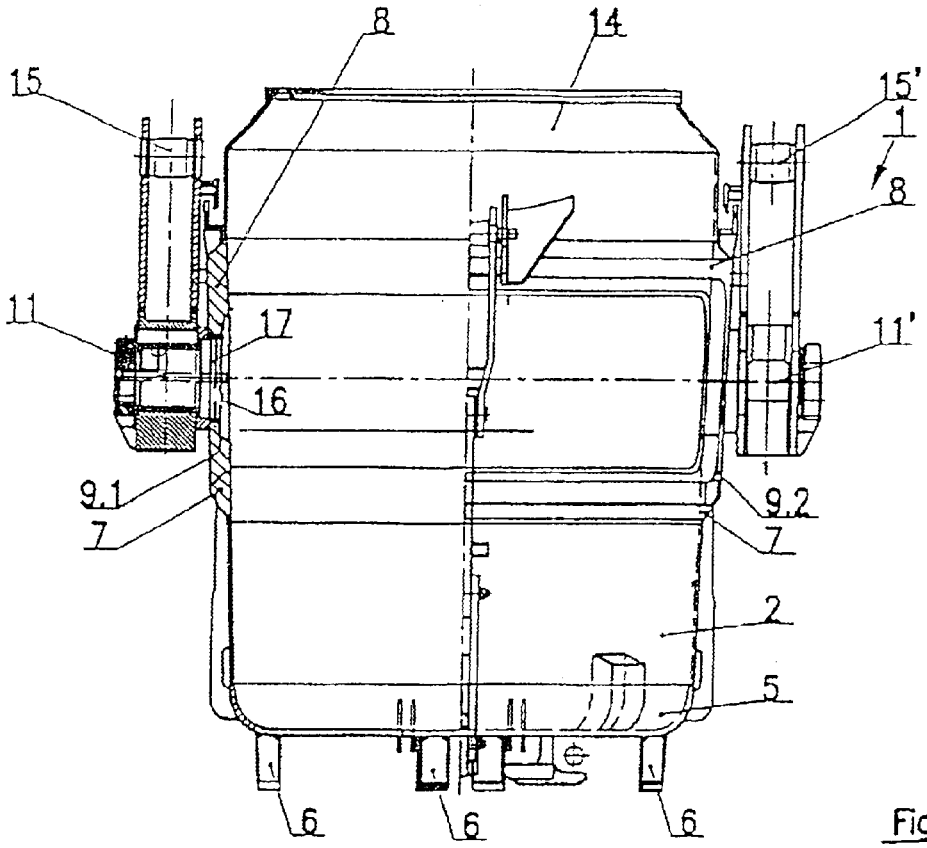
FIG. 3 shows on left half, a cross-section in the direction III—III in FIG. 1; and on right half, the corresponding view.
Figure 6:
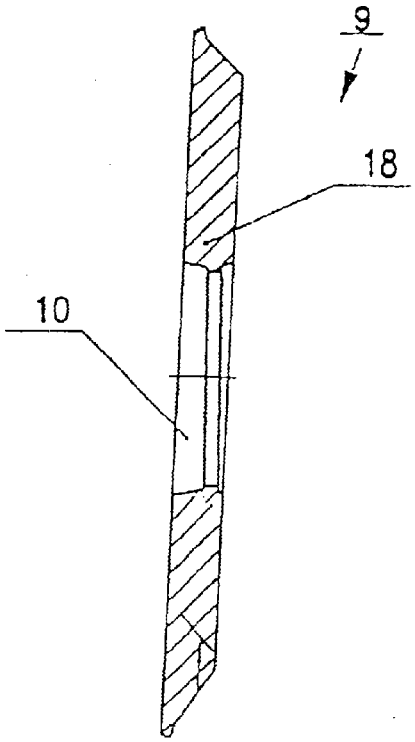
FIG. 6 is a sectional view of the shield segment, taken in the direction VI—VI in FIG. 4.

Turning now to the drawing, and in particular to FIGS. 1–3, there is shown an outside view, a top view, and a cross-sectional view of a metallurgical vessel, illustrated here in the form of a steel casting ladle 1, formed according to the invention in. The ladle 1 consists of a metal jacket formed of lengths of pipe 2–4 and receiving a heat resistant lining, and a bottom 5 as well as base elements 6. Integrated in the metal jacket are two circumferential stiffening rings 7, 8 and corresponding shield segments 9, 9' disposed between the stiffening rings 7. Lifting lugs 11, 11' are each welded into a corresponding opening 10 (FIG. 4) provided in the shield segment 9. On the outside—located here on the left—a tilting mechanism 12 is secured for tilting the steel casting ladle 1 with the help of a crane (not shown). In this embodiment, the upper rim 13 of the vessel is connected with a lid support formed as an annular lid 14. The annular lid 14 has preferably a frusto-conical cross-section. The steel casting ladle 1 depicted in FIG. 2 has an oval cross-section.

FIG. 3 shows two different embodiments of the shield segment 9 in a partial section and a view. FIG. 3 also shows the hooked loops 15, 15' from which the lifting lugs 11, 11' are suspended. In the partial section on the left, the one-piece shield segment 9.1 has on the inside a recess 16 with an area that is larger than the area of the inner surface 17 of the lifting lug 11. An insulating layer for lowering the temperature of the lifting lug can be arranged in the recess. The shield segment 9.2 depicted in the right-hand view, on the other hand, is formed on the inside and is continuously smooth.

Figure 4:
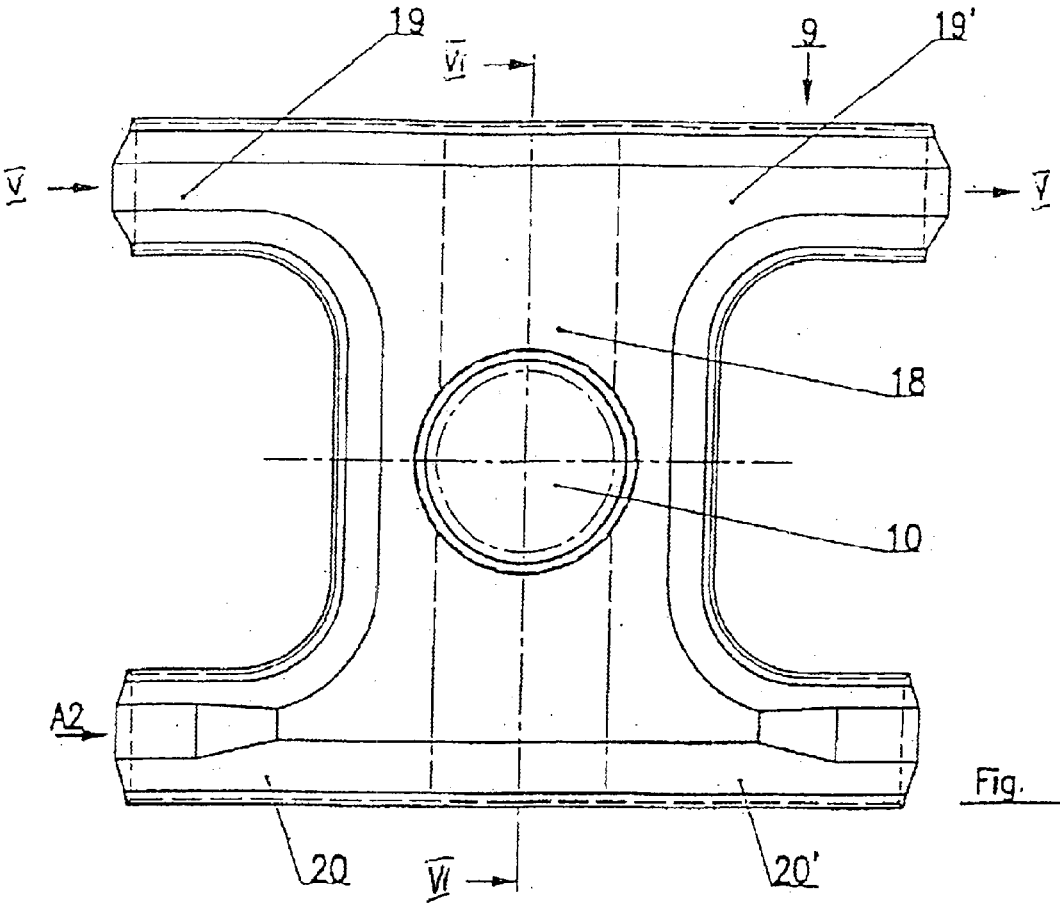
FIG. 4 is a view of the shield segment formed according to the invention.

The shield segment 9 formed according to the invention is shown in detail in FIG. 4. It has an almost rectangular center section 18 with the opening 10 for receiving the respective lifting lug 11, 11'. In the upper and lower region, a corresponding arm 19, 19', 20, 20' extends to the right and left following the center section 18. The shape and cross-section of the end region of these arms matches that of the corresponding stiffening ring 7, 8. The end regions are formed as weld edges for forming a material connection between the corresponding shield segment 9, 9' and the stiffening rings 7, 8.

Figure 5:
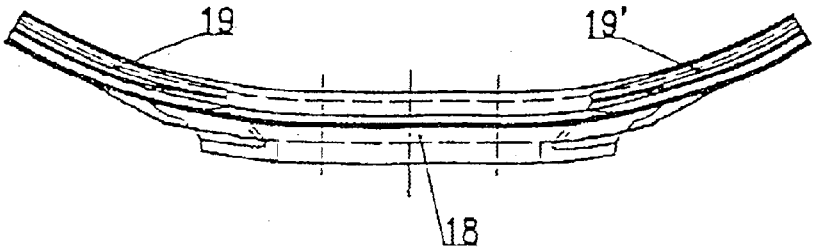
FIG. 5 is a sectional view of the shield segment, taken in the direction V—V in FIG. 4.

Since the steel casting ladle 1 has an oval cross-section, the center section 18 is straight (FIG. 5) whereby the length of the peripheral straight section is commensurate with the degree of ovality. The adjacent regions are bent to ensure a clean connection with the metal jacket and the stiffening rings 7, 8, respectively.

Figure 7:
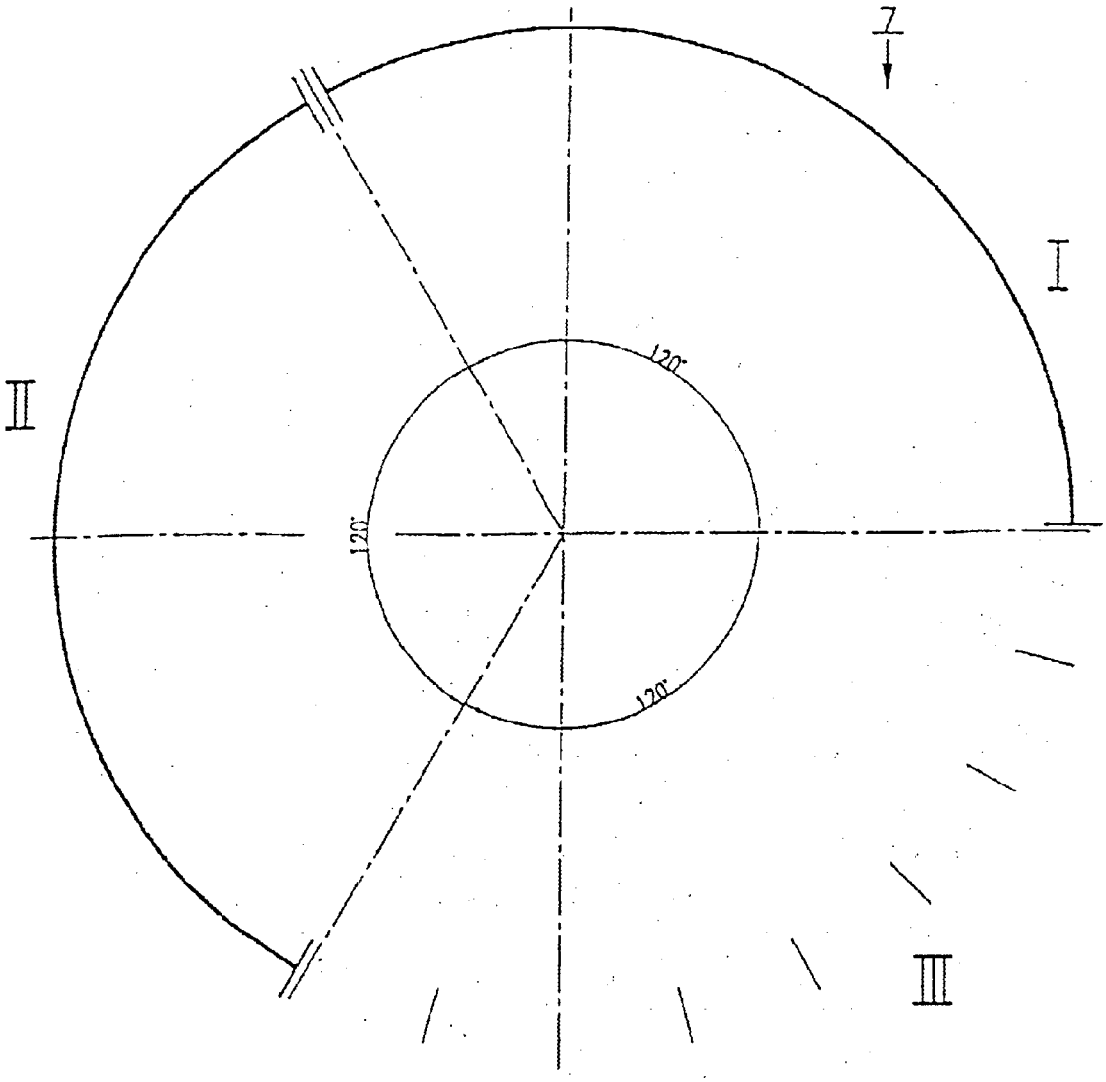
FIGS. 7–9 are diagrams depicting aspects of the manufacturing process.
Figure 8:
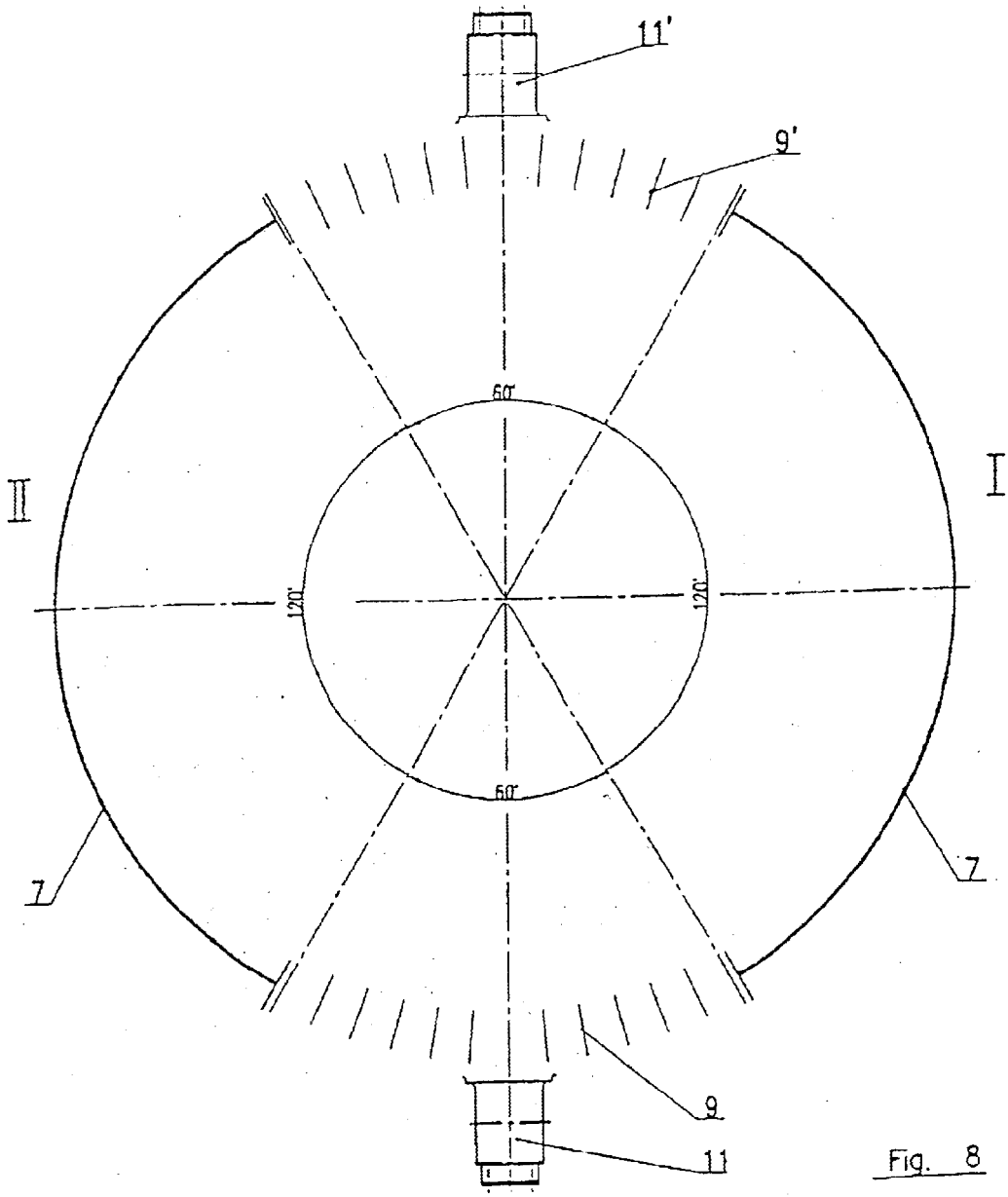
Figure 9:
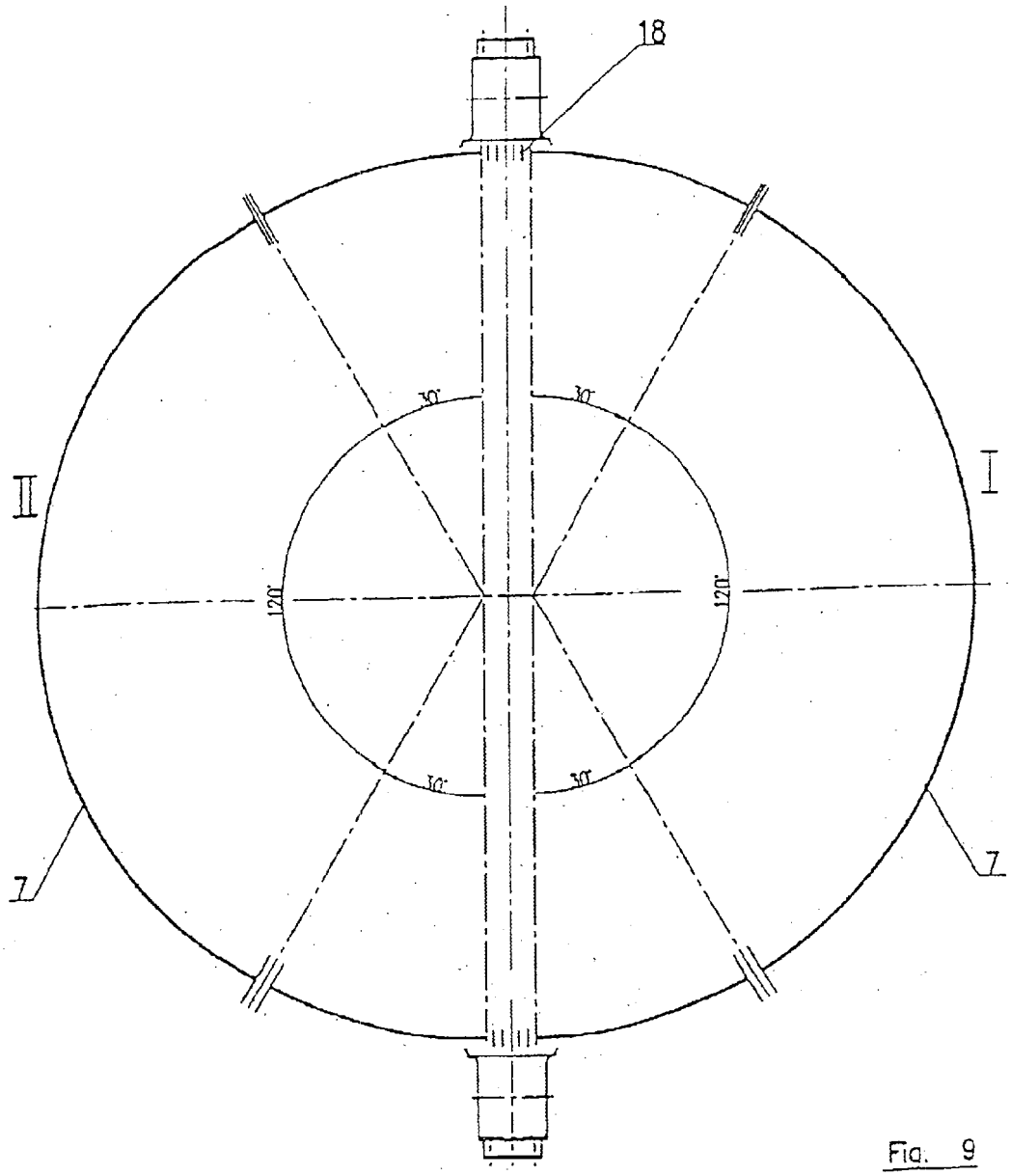

FIGS. 7–9 illustrate schematically a proposed manufacturing process for the stiffening rings 7, 8, outlining, for example, the method for producing the lower stiffening rings 7. In a first step, the forged 360° solid ring is separated into three 120° segments I, II, III. The third 120° segment III is shown with dotted lines to indicate that this segment is not used for the first vessel. FIG. 8 shows how the support structure is formed from the two 120° segments I, II and the two 60° shield segment 9, 9'. The upper stiffening ring 8 should also be included for a complete structure. Those skilled in the art will understand that the upper stiffening ring 8 can be produced and separated in the same manner. The lifting lugs 11, 11' are also illustrated to more clearly show that the intermediate parts are the 60° shield segments. When selecting the dimensions of the 60° shield segments 9, 9', the cutting waste generated during cutting should be taken into account.

FIG. 9 shows the variant for producing a steel casting ladle 1 with a substantially oval cross-section. Similar to the embodiment of FIG. 5, the center section 18 is straight and the two adjacent sections are each bent to form a 30° segment, so that altogether a 60° segment is produced. The cutting waste has also to be taken into consideration.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

What is claimed is:

1. A metallurgical vessel for transporting molten metals, comprising:

a metal jacket having a heat resistant lining and two circumferential, axially spaced stiffening rings which are secured to and integrated with the metal jacket;

two lifting lugs arranged in opposing disposition on an outside surface of the metal jacket; and shield segments connected with the stiffening rings, with each shield segment supporting a corresponding lifting lug and having a rounded transition from the stiffening rings to the shield segment, wherein each shield segment is formed as a single piece, with at least an upper region of the shield segment comprising arms extending in both circumferential directions of the metal jacket, and wherein end regions of the arms have a weld edge and a cross-section that is matched to a cross-section of the stiffening ring proximate to the arms.

2. The metallurgical vessel of claim 1, wherein an upper and a lower region of the shield segment comprise arms extending in both circumferential directions.

3. The metallurgical vessel of claim 1, wherein the shield segment has a small radial spacing to the metal jacket.

4. The metallurgical vessel of claim 3, wherein only an upper marginal region of the shield segment is materially connected with the stiffening ring and an opposite free marginal region of the shield segment is guided in the vertical direction by guide means arranged on the stiffening ring.

5. The metallurgical vessel of claim 2, wherein the shield segments are part of the metal jacket.

6. The metallurgical vessel of claim 5, wherein an inside of the shield segment has a recess with a cross-sectional area that is at least as large as a cross-sectional area of an end face of the lifting lug facing the outside surface of the metal jacket.

7. The metallurgical vessel of claim 1, and further comprising a lid support with a frusto-conical cross-section attached on a rim of the vessel.

8. A metallurgical vessel for transporting molten metals implemented as a welded construction, comprising a metal jacket being made of individual lengths of tube and having a heat resistant lining and two axially spaced sections of stiffening rings which each extend about 120° along the periphery of the metal jacket and are secured to an outside surface of the metal jacket;

two shield segments connected with the sections of the stiffening rings and forming a support structure, each shield segment has a rounded transition from the sections of the stiffening rings to the shield segment; and two lifting lugs arranged in opposing disposition on the outside surface of the metal jacket and being welded into an opening of the shield segment, wherein each shield segment extends over 60° along the periphery of the metal jacket and is formed as a single piece, with at least an upper region of the shield segment comprising arms extending in both circumferential directions of the metal jacket, and wherein end regions of the arms have a weld edge and a cross-section that is matched to a cross-section of the section of the stiffening ring proximate to the arms.

9. The metallurgical vessel of claim 8, wherein the 120° sections of the stiffening rings are produced by cutting a 360° stiffening ring and a peripheral length of the 60° shield segments is adjusted for cutting waste produced when the 360° stiffening ring is cut.

10. The metallurgical vessel of claim 8, wherein the vessel has a substantially oval cross-section when viewed in an axial direction, and the shield segment is shaped so as to conform to the substantially oval cross-section.

11. The metallurgical vessel of claim 8, wherein the shield segment is produced as one-piece from a thick sheet metal by rolling a cast ingot into the thick metal sheet, sizing and bending the sheet metal into a suitable shape, eroding a contour and the opening of the shield segment for the lifting lug by heat, and finish machining of the contour.

12. The metallurgical vessel of claim 11, wherein a re-forming ratio from the cast ingot to the thick metal sheet corresponds at least to a forging ratio of a conventionally produced shield segment.

13. The metallurgical vessel of claim 8, wherein the 120° sections of the stiffening rings are rolled as straight a profile which is cut to a predetermined length before being bent into a circular arc profile, with the end regions being mechanically finished.

14. A method for producing a metallurgical vessel for transporting molten metals implemented as a welded construction, comprising the steps of:

fabricating a metal jacket of individual lengths of tube;

connecting to the metal jacket a support structure formed of stiffening rings and shield segments; and welding in each of the shield segments a corresponding lifting lug, wherein a 360° stiffening ring is separated into three segments, with each of the segments having a peripheral extent of 120°, and wherein the support structure is formed of two 120° segments and two shield segments having each a peripheral extent of 60°.

15. The method of claim 14, wherein the peripheral length of the 60° shield segments is adjusted for cutting waste produced when the 360° stiffening ring is separated.

16. The method of claim 14, wherein a substantially straight section that matches a substantially oval cross-section of the vessel is formed in the shield segment.

17. The method of claim 14, wherein the shield segment is produced from a thick metal sheet by rolling the thick metal sheet starting with a cast ingot; sizing and bending the thick metal sheet either cold or warm with a press into a suitable shape; eroding by heat a contour of the shield segment and an opening in the shield segment for the corresponding lifting lug, and machining of the final contour by mechanical finishing.

18. The method of claim 17, wherein a re-forming ratio from the cast ingot to the thick metal sheet corresponds at least to a forging ratio of a conventionally produced shield segment.

19. The method of claim 14, wherein the 120° segments of the stiffening rings are produced by rolling a straight profile; cutting the rolled straight profile into segments having a predetermined length; bending the cut segments into a 120° circular arc profile, and mechanically finish machining the end regions.

* * * * *